United States Patent [19]

Tesch

[11] Patent Number: 4,949,411

[45] Date of Patent: Aug. 21, 1990

[54] PILLOW WITH CONVERGING EDGE CHAMBERS

[76] Inventor: Günter Tesch, Avenue Jean-Marie-Musy 15, CH-1700 Fribourg, Switzerland

[21] Appl. No.: 272,413

[22] Filed: Nov. 17, 1988

[30] Foreign Application Priority Data

Nov. 20, 1987 [DE] Fed. Rep. of Germany ..... 3739449
Jan. 12, 1988 [DE] Fed. Rep. of Germany ..... 3800639

[51] Int. Cl.[5] ..... A47C 16/00

[52] U.S. Cl. ..... 5/434; 5/436; 5/442; 5/464

[58] Field of Search ..... 5/434, 436, 437, 438, 5/441, 442, 464, 480, 439, 452, 455, 457, 474

[56] References Cited

U.S. PATENT DOCUMENTS

| | | | |
|---|---|---|---|
| 1,020,444 | 3/1912 | Platt | 5/436 |
| 1,206,775 | 11/1916 | Everts | 5/442 |
| 1,703,175 | 2/1929 | Rollins | 5/480 |
| 2,919,747 | 1/1960 | Post | 5/457 |
| 4,459,714 | 6/1984 | Lin | 5/455 |
| 4,501,034 | 2/1985 | Greenawalt | 5/434 X |
| 4,513,462 | 4/1985 | Thomas . | |
| 4,660,239 | 4/1987 | Thomas . | |

FOREIGN PATENT DOCUMENTS

| | | | |
|---|---|---|---|
| 2749596 | 5/1979 | Fed. Rep. of Germany | 5/442 |
| 8313300.3 | 5/1983 | Fed. Rep. of Germany . | |
| 8405166 | 7/1984 | Fed. Rep. of Germany . | |
| 799868 | 6/1936 | France . | |

*Primary Examiner*—Michael F. Trettel
*Attorney, Agent, or Firm*—Bacon & Thomas

[57] ABSTRACT

A pillow for resting the head is described. The pillow has a cover, the inside of which is divided into a plurality of chambers optionally filled with different filler materials and/or to a different degree; the pillow being more versatile and variable than known pillows. The chambers include a principal chamber, and on at least two of its lateral edges, tubular-like chambers. The pillow thus comprises not only a chamber to be used as a neck roll, but at least one additional separate chamber, on which the head may be supported in a lateral position, but which may also be used optionally as a neck roll. The hardness of the principal chamber and of the individual tubular-like chambers may be differentially variable. In addition, corner chambers may be provided, which contain refill materials for the other chambers, or serve as a storage compartment for valuable objects or the like. The individual chambers are accessible by means of zipper closures or the like.

20 Claims, 4 Drawing Sheets

PILLOW WITH CONVERGING EDGE CHAMBERS

This invention concerns a pillow for resting the head with a cover, the inside of which is divided, as viewed over the surface of the pillow, into several adjacent chambers filled with filling material.

Pillows of this type are known in different forms.

A pillow with a rectangular base format is described in DE-U-8.313.300, which comprises along one longer lateral edge an elongated chamber, spaced apart by the two shorter lateral edges. This chamber extends along the lateral edge over the entire cross section of the pillow and may have a width corresponding to approximately one-third to one-half of the width of the pillow. The rest of the pillow forms its own chamber, surrounding the elongated chamber on three sides. The elongated chamber forms a neck support and is therefore provided with a filling having about twice the hardness of the rest of the pillow. The pillow is filled with foam bodies equipped with edging rods. Foam pellets may also be present in the pillow as fillers. The differential hardness is obtained by varying the size of the rod or the crushing resistance or by determining the fill volume of the edging rods.

Another pillow is described in DE-U-8.427.664, which along one lateral edge contains a tubular-like chamber with a hardness different from the rest of the pillow. A third chamber is further provided, which overlaps the two other chambers at least in the area of the joint of the two first chambers. The three chambers are filled with filler materials of different elasticities. The tubular-like chamber may be filled with a roll of fleece, in particular of shorn wool, the second chamber with strong feathers and the overlapping chamber with feathery down.

While both of these pillows have a neck roll and therefore are well suited for sleeping on one's back, they provide no support for the head, when the person using the pillow sleeps on his side. Furthermore, the user of the pillow cannot adapt it to his own desires.

A triangular pillow is described in DE-U-8.405.166, which in its center comprises a triangular trough and on its circumferential edge a correspondingly triangular tubular portion. If a person lies on his back, his head is resting essentially in the trough, while his neck is supported by a lateral tubular portion. If the person is resting on his side, his head is supported by one of the two other lateral tubular portions.

Pillows are described in U.S. Pat. No. 4,513,462 and U.S. Pat. No. 4,660,239, and comprise a principal chamber extending over the entire area of the pillow. Additional chambers are arranged on three or four sides, respectively, of the pillow, so that an upper and a lower part of the pillow are formed. At least in the center part of the pillow only the principal chamber is present. This yields at least one tubular neck support. Two more tubular supports are provided for the head of the person sleeping on his side. The chambers of the pillows are filled differentially, with the principal chamber being stuffed with a soft and elastic material.

Essentially rectangular pillows are also known, the longitudinal edge of which is provided with a more solid tubular bead which serves as a neck support. It is also known to arrange such tubular beads parallel to each other.

It is the object of this invention to provide a pillow of the aforementioned generic type, that has multiple applications and on which it is possible to sleep more comfortably.

This object is attained by the present invention. The pillow according to the present invention has tubular-like chambers on at least two lateral edges. The pillow according to the invention thus not only comprises a chamber to be used as a tubular neck support, but also at least one additional separate chamber upon which the head may rest in the lateral position, but which may also be used as a neck support.

According to a particular form of embodiment of the invention the pillow has a triangular base configuration, so that optionally all three lateral edges may represent tubular supports.

As a rule, the pillow is rectangular, but may be square in a special case. Two, three or four lateral edges may have tubular-like chambers.

The hardness of the filling in the individual tubular-like chambers may be different. The user is thus not only able to select one or the other tubular-like chamber to support his neck, but it is also possible to choose a particular hardness of the chambers for the lateral position.

An additional chamber may be provided in one corner of the pillow, in which two tubular-like chambers meet.

At least one chamber located in one corner of the pillow should be accessible by means of a releasable closure, such as a zipper, a Velcro® hook and loop fastener, or the like. The user could keep valuable objects, such as jewelry, money, or the like, in this corner chamber. The user usually is not resting on the corners, so the presence of a hard object will not be uncomfortable.

Advantageously, all of the chambers of the pillow are accessible from the outside.

The individual chambers may also be formed by appropriately quilting the pillow. Preferably, however, the chambers are separated by rows of stitching, so that the pillow does not have thin locations of the cover material only between the chambers and that it will have a full appearance without the chambers being immediately visible from the outside.

At least one corner of the pillow may be left without the aforedescribed chambers, so that the tubular-like chambers are in contact with each other in a line only (for example a seam). As the tubular-like chambers may have different volumes, and in particular their cross section may be different, the manufacture of a pillow with plain corners may be simpler than if the transitions between the individual chambers in the corners are shaped separately.

Spherical fiber aggregates fill at least part of the chambers, such spherical fiber aggregates being described for example in DE-A-2 301 913, EP-A-0.013.427 or EP-A-0203.469. These may have different hardnesses. They may also be made of different materials and may consist, for example, of wool and/or synthetic fibers. The pile density may be different in the individual chambers, whereby the hardness of the chamber may also be affected.

A pillow with a triangular configuration has an interesting appearance and attracts the attention of the viewer. For this reason, it is suitable for use as a display pillow in the show rooms of a store selling pillows with different pillow chamber configurations, whereby the customer is able to test different hardnesses on a single pillow and thus decide on a particular one.

Particularly in the case of such triangular display pillows, the corners may be completely absent.

Further details and advantages of the invention will become apparent from the appended claims and the following examples of embodiment described with reference to the drawing.

Figure 6:
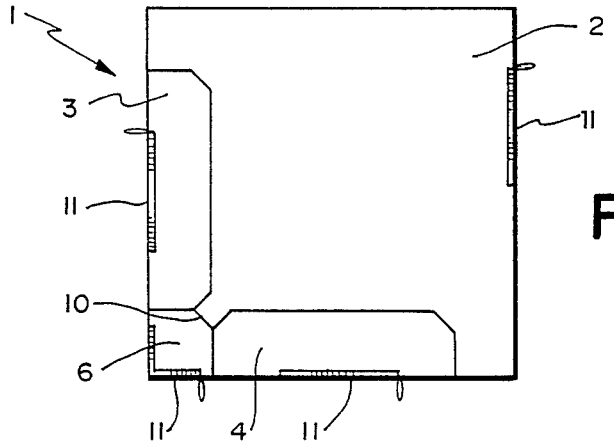
Figure 7:
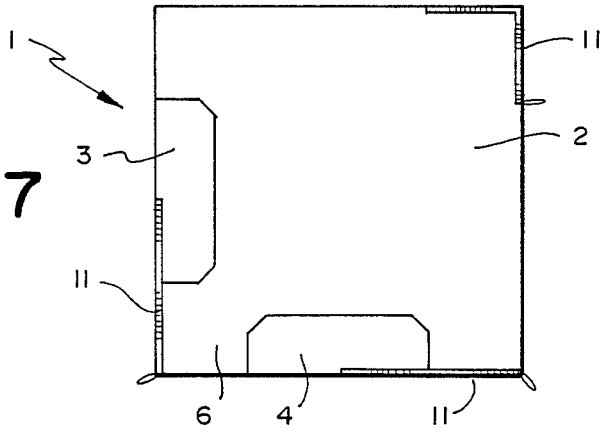
Figure 8:
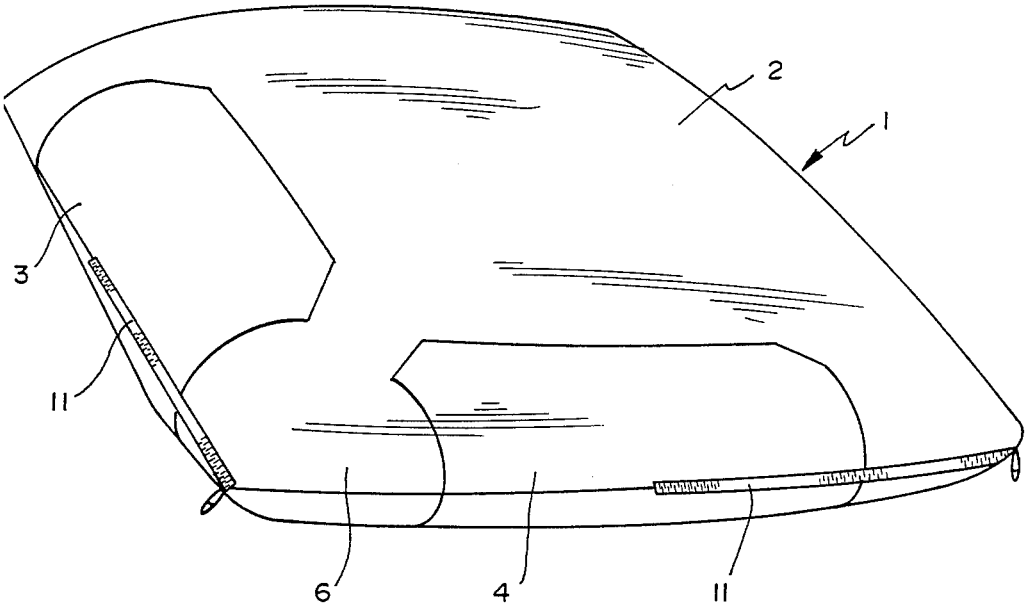

FIG. 6 shows a square pillow with a principal chamber and with chambers located in one corner and at the two longitudinal sides meeting therein, according to a third embodiment; and FIG. 7 shows a square pillow with a principal chamber and with chambers located in one corner and at the two longitudinal sides meeting therein, according to a fourth embodiment; and FIG. 8 shows the pillow according to FIG. 6 in a perspective view.

A pillow 1 consists of a plurality of chambers 2 to 8, wherein in addition to a principal chamber 2, at least one each at two long sides of the pillow 1, a tubular-like chamber 3, 4 or 5 is formed, and in the corners of the pillows additional chambers 6, 7 or 8 are provided or else said corners are left plain.

The chambers 2 to 8 are separated for example by walls constituting webs from each other, said walls being fastened or sewn to the cover of the pillow in a known manner.

At least part of the chambers 2 to 8 may be accessible from the outside by means of closures capable of being opened, shown for example in FIG. 5 to 8, such as a zipper 11, a Velcro® hook and loop fastener, or the like, directly or through another chamber, so that the user may add or remove filler material to or from the pillow.

The principal chamber 2 usually supports the head in the so-called supine position. The tubular-like chambers 3, 4 and 5 located on the sides of the pillow 1 may be used, depending on their configuration and the wishes of the user, to support the neck in the supine position, or the head in a lateral position.

Figure 1:
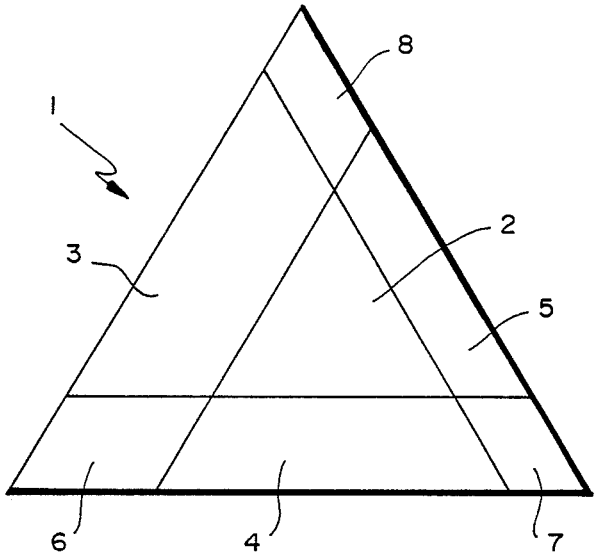
FIG. 1 shows a triangular pillow with a principal chamber and with chambers located on its three longitudinal sides and in the three corners.
Figure 2:
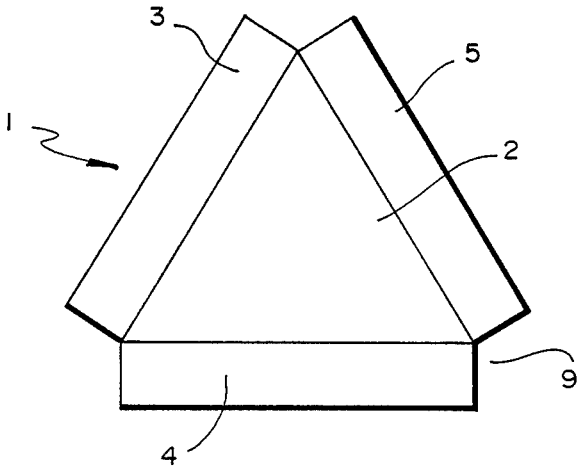
FIG. 2 shows a triangular pillow with a principal chamber and chambers located at its three longitudinal sides with plain corners.

FIG. 1 and 2 each shows a triangular pillow 1, drawn here with equal sides, but it may also be isosceles, or all three sides may have different lengths. Both pillows 1 have a principal chamber 2 in the center and tubular-like chambers 3, 4 and 5 at their three sides.

According to forms of embodiments not shown, only two sides have tubular-like chambers, while the principal chamber 2 extends to the third lateral edge of the pillow.

In the case of the pillow according to FIG. 1, the tubular-like chambers 3, 4 and 5 have different cross sections, which are obtained because the web forming walls are spaced differently from the associated lateral edge of the pillow 1.

A different chamber volume may also be obtained if the web forming walls have different heights, whereby the distance of the two cover parts defining the pillow 1 is varied. Obviously, the two embodiments may be combined with each other.

In the corner of the pillow 1 according to FIG. 1 additional chambers 6, 7 and 8 are provided. These chambers 6, 7 and 8 are formed because the web forming walls extend intersectingly to the lateral edges of the pillow 1. The chambers 6, 7 and 8 in the corners can now be filled with stuffing material, but they may also be empty and serve as receptacles for objects, for example jewelry, watches or the like. For this purpose, such a corner chamber 6, 7 or 8 has an openable closure, such as a zipper, Velcro® hook and loop fastener or the like, or merely some overlapping sections of fabric.

The pillow 1 according to FIG. 2 is characterized in that the corners 9 are plain. Here again, the tubular-like chambers 3, 4 and 5 may be filled differently or have different volumes.

Figure 3:
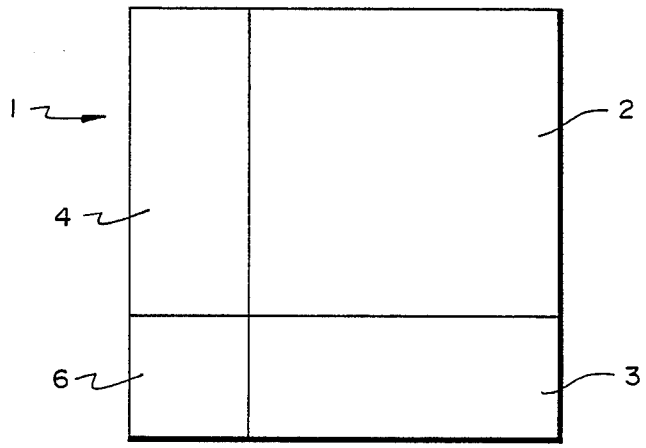
FIG. 3 shows a square pillow with a principal chamber and with chambers located in one corner and at the two longitudinal sides meeting in said corner.

THe pillow 1 according to FIG. 3 has a square base configuration and comprises in addition to a principle chamber 2, chamber 6 at a corner, and beginning at this corner, chambers 3 and 4 at each lateral edge. Chambers 3 and 4 here have the same cross-sections, but are filled differently for example with different fibers or with a different weight, while the corner chamber 6 may be empty and serves as a "storage chamber ". The corner chamber 6 then has a square configuration.

Figure 4:
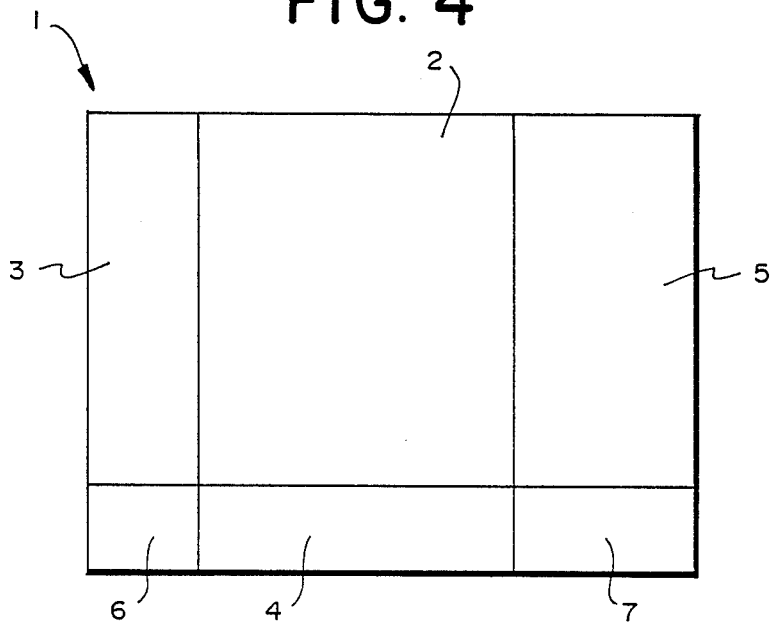
FIG. 4 shows a rectangular pillow with a principal chamber and with chambers located in two corners and on the three longitudinal sides meeting therein.

The pillow according to FIG. 4 is rectangular, with one lateral edge having a length of for example 80 cm, while the other lateral edge is for example 60 cm long. The cross section of the individual tubular-like chambers here is different, resulting in a rectangular configuration of different size for the corner chambers 6 and 7.

The tubular-like chamber 4 located between the two corner chambers 6 and 7 is used for example to support the neck in the supine position. But the pillow 1 according to FIG. 4 is also particularly well suited as a so-called demonstration pillow in the sale of pillows, as it has tubular-like chambers 3, 4 and 5 of different widths, which may also be filled differently.

FIGS. 5 to 8 show various other forms of embodiment of square pillow 1. They have in common that each contains two chambers 3 and 4 on the longitudinal sides and one of them a chamber 6 in a corner enclosed by said chambers 3 and 4 with the longitudinal chambers 3 and 4 being bevelled off on the side facing the principal chamber 2, at the corners, so that the corner chamber 6 has a connection with the principal chamber 2.

Figure 5:
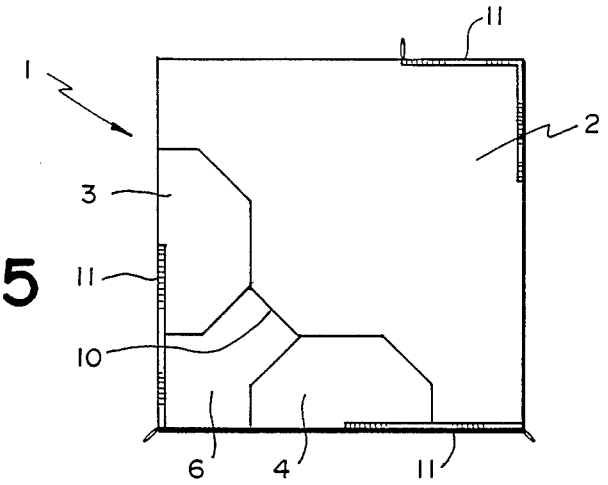
FIG. 5 shows a square pillow with a principal chamber and with chambers located in one corner and at the two longitudinal sides meeting therein, according to a second embodiment.

This connection is channel shaped and is closed by a web 10 in the embodiments according to FIGS. 5 and 6. This web 10 is located in the embodiment according to FIG. 5 at the end of the connecting channel on the side of the principal chamber, and in the embodiment according to FIG. 6 at the end of connecting channel on the side of the corner chamber. In the embodiment according to FIG. 7, this connection is open.

It is further apparent from FIGS. 5 to 7, that the longitudinal chambers 3 and 4 have different widths and/or lengths depending on the form of embodiment and that they may also have bevels, leading to different sizes of the principal chamber 2 and the corner chamber 6.

It is also seen in FIGS. 5 to 7, that the openable closures, such as zippers, Velcro® hook and loop fasteners, or the like, may be located and associated differently. The principal chamber 2 will usually always have a zipper 11 or the like, located in the corner (FIGS. 5 and 7) opposite the corner chamber or in a lateral edge without a longitudinal chamber (FIG. 6). The two longitudinal chambers 3 and 4 and the corner chamber 6 may also have a zipper 11 intended for them alone (FIG. 6), but a zipper 11 may also be provided for two adjacent chambers 3 and 6 or 2 and 4 (FIGS. 5 and 7).

It is seen in particular in FIG. 8 that the zippers 11 are located in the circumferential seam of the pillow 1, which greatly simplifies their insertion.

The pillows according to FIGS. 3, 5 and 7 are especially well suited for reversal by the sleeping person, so that his neck is resting in the supine position on the corner chamber 6 and/or the connecting channel, while his head is supported in the lateral position by one of the longitudinal chambers 3 and 4.

As the corner chambers do not contribute materially to sleeping comfort, one or several corner chambers 6, 7 or 8 of the aforedescribed pillow 1 according to FIGS. 1 to 6, may also be used as a reserve compartment for the filler materials of the other chambers 2 to 5, i.e., these corner chambers are filled when the pillow is purchased with the same materials as the other chambers. Should the user desire to fill one or the other chamber 2 to 5 more fully, thereby rendering it more solid, he may take the filler materials from the corner chambers and introduce them into the chambers 2 to 5, to be stuffed more fully.

For this purpose, preferably in the seam between the upper and the lower halves of the cover, zippers or the like, are provided. They are shown in FIGS. 5 to 8 only. Following the opening of the zipper, fiber aggregates may be taken out or added. The fiber aggregates are handled very easily, in contrast to down or feathers, as the individual fiber aggregates are attached to each other by the hooking into each other of the fibers, but may be separated without having to use force.

This condition is also utilized if the pillow should be slightly settled after a certain period of time, as the fibrous aggregate filler may always be loosened up again. Usually, however, it is sufficient to slightly shake the pillow 1, in particular if only the outward appearance of the pillow 1 is affected.

The fundamental manufacturing process of the fibrous aggregate is described for example in DE-A-2 301 913, EP-A-0.013.427 or EP-A-0.203.469. The fiber aggregates used are manufactured and marketed under the trademark "SCHLAFKUGELN" by the Fabromont AG Co., CH-3185, Schmitten. The fiber aggregates are made of intertwined fibers and/or filaments and consist of synthetic fibers and/or wool fibers.

I claim:

1. A pillow with a cover, the inside of which is divided into several adjacent individual chambers, as viewed over the area of the pillow, said chambers being filled with filler material, wherein the pillow comprises at least one principal chamber and at least two lateral edges of the pillow converging toward a common corner with each edge containing an individual tubular-like chamber that extends substantially the entire length of the edge and that border the principal chamber, wherein at least one of the chambers is filled with spherical fiber aggregates and wherein all of the chambers are accessible by means of an openable closure.

2. A pillow according to claim 1, wherein the pillow has a triangular base configuration.

3. A pillow according to claim 1, wherein the pillow is rectangular or square.

4. A pillow according to claim 3, wherein the pillow has tubular-like chambers on three of its lateral edges.

5. A pillow according to claim 1, wherein the hardness of the principal chamber and of the individual tubular-like chambers may be adjusted differentially.

6. A pillow according to claim 1, wherein all of the chambers are accessible by means of an openable closure, such as a zipper, a hook and loop fastener, or the like.

7. A pillow according to claim 1, wherein chambers have obliquely cut corners adjacent the principal chamber.

8. A pillow according to claim 1, wherein at least one corner of the pillow does not comprise a chamber.

9. A pillow according to claim 1, wherein at least one of the chambers is filled with spherical fiber aggregates.

10. A pillow according to claim 9, wherein different chambers have different hardnesses.

11. A pillow according to claim 10, wherein the hardness difference is due to the fibers used as fillers.

12. A pillow according to claim 10, wherein the hardness difference is due to different hardnesses of the spherical fiber aggregates used as fillers.

13. A pillow according to claim 10, wherein the hardness difference is due to different degrees of filling.

14. A pillow according to claim 10, wherein the hardness difference is due to different cross sections or volumes.

15. A pillow according to claim 1, wherein different chambers are filled with different fiber aggregates.

16. A pillow with a cover, the inside of which is divided into several adjacent individual chambers, as viewed over the area of the pillow, said chambers being filled with filler material, wherein the pillow comprises at least one principal chamber and at least two lateral edges of the pillow converging toward a common corner with each edge containing an individual tubular-like chamber, with an additional chamber being located in said common corner of the pillow, toward which said two tubular-like chambers converge.

17. A pillow according to claim 16, wherein said common chamber is accessible by means of an openable closure, such as a zipper, a hook and loop fastener, or the like.

18. A pillow according to claim 16, wherein said common chamber is connected with the principal chamber.

19. A pillow according to claim 18, wherein the connection of the chamber with the principal chamber is interrupted by a web.

20. A pillow with a cover, the inside of which is divided into several adjacent individual chambers, the individual chambers being separated by walls comprised of webs, as viewed over the area of the pillow, said chambers being filled with filler material, wherein the pillow comprises at least one principal chamber and at least two lateral edges of the pillow converging toward a common corner with each edge containing an individual tubular-like chamber that extends substantially the entire length of the edge and that border the principal chamber, wherein at least one of the chambers is filled with spherical fiber aggregates and wherein all of the chambers are accessible by means of an openable closure.

* * * * *